US008973480B2

(12) United States Patent
Bowen et al.

(10) Patent No.: US 8,973,480 B2
(45) Date of Patent: Mar. 10, 2015

(54) MISSILE CANISTER

(75) Inventors: Bryan Bowen, Letchworth Garden City (GB); Anthony Machell, Bedfordshire (GB); Terence Edward Kavanagh, Bedfordshire (GB); Dennis George Turner, Hertfordshire (GB)

(73) Assignee: MBDA UK Limited, Stevenage, Hertfordshire (GB)

( * ) Notice: Subject to any disclaimer, the term of this patent is extended or adjusted under 35 U.S.C. 154(b) by 75 days.

(21) Appl. No.: 13/816,850

(22) PCT Filed: Aug. 15, 2011

(86) PCT No.: PCT/GB2011/051536

§ 371 (c)(1),
(2), (4) Date: Feb. 13, 2013

(87) PCT Pub. No.: WO2012/022964

PCT Pub. Date: Feb. 23, 2012

(65) Prior Publication Data

US 2013/0139676 A1 Jun. 6, 2013

(30) Foreign Application Priority Data

Aug. 17, 2010 (EP) ..... 10251453
Aug. 17, 2010 (GB) ..... 1013740.4

(51) Int. Cl.
*F41F 3/04* (2006.01)
*F41F 3/042* (2006.01)
*F42B 39/14* (2006.01)

(52) U.S. Cl.
CPC ..... *F41F 3/042* (2013.01); *F42B 39/14* (2013.01)
USPC ..... 89/1.8; 89/1.816

(58) Field of Classification Search
CPC ..... F41F 3/042; F41F 3/073; F41F 3/077; F41F 3/0413; F41F 3/06; F41F 3/04; F41F 3/052
USPC ..... 89/1.8–1.819
See application file for complete search history.

(56) References Cited

U.S. PATENT DOCUMENTS 5,115,711 A * 5/1992 Bushagour et al. ..... 89/1.816
5,833,782 A * 11/1998 Crane et al. ..... 156/60
2002/0096041 A1* 7/2002 Briggs et al. ..... 89/1.817
2004/0194614 A1* 10/2004 Wang ..... 86/50

FOREIGN PATENT DOCUMENTS

CH 411 626 A 4/1966
TW 264 341 B 10/2006

OTHER PUBLICATIONS

International Preliminary Report on Patentability and Written Opinion, dated Feb. 28, 2013 from related International Application No. PCT/GB2011/051536.
International Search Report dated Nov. 7, 2011 issued in PCT/GB2011/051536.
Extended European Search Report dated Mar. 11, 2011 issued in European Publication No. EP 10251453.6.

* cited by examiner

*Primary Examiner* — Samir Abdosh
(74) *Attorney, Agent, or Firm* — Scully, Scott, Murphy & Presser, PC

(57) ABSTRACT

The invention covers a missile canister (10) for accommodating a missile (20) along a longitudinal axis (L) of the canister. The canister comprises a plurality of generally planar longitudinal wall portions (14) connected together to form a tubular vessel having a polygonal cross-section. The interconnecting portions (16) between wall sections (14) are generally flexible so that when a missile (20) is launched the bending moment at the interconnecting portions (16) generated by the increase of pressure in the vessel is substantially less than the bending moment (10) generated at the wall portions (14). The interconnecting portions (16) allow relative angular deflection between adjacent wall portions (14) at respective interconnecting portions (16) when said missile (20) is launched.

9 Claims, 9 Drawing Sheets

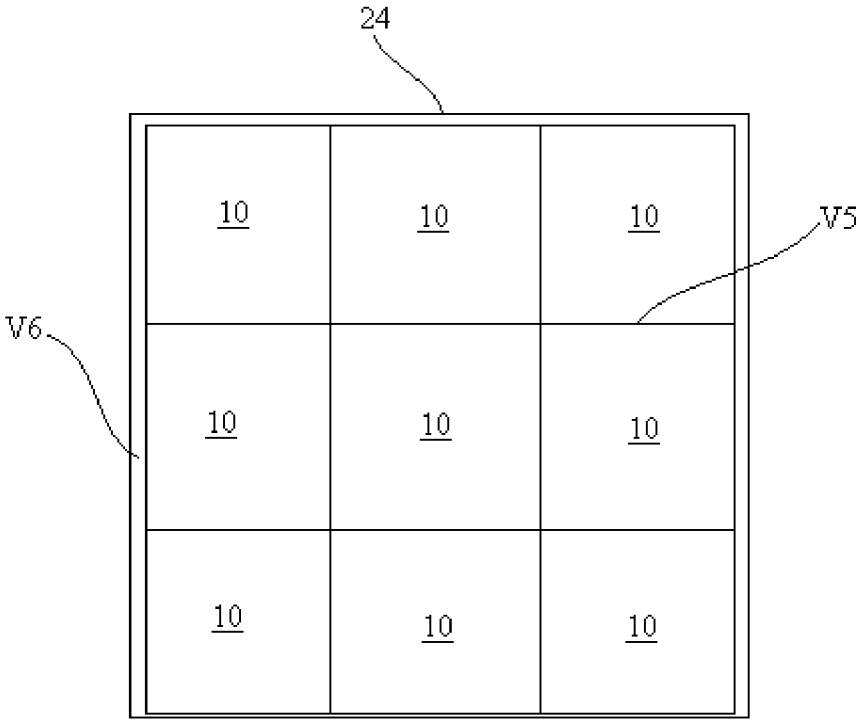
FIG. 3
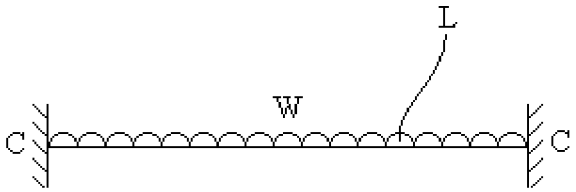
FIG. 5
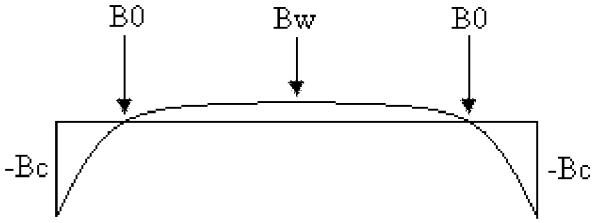

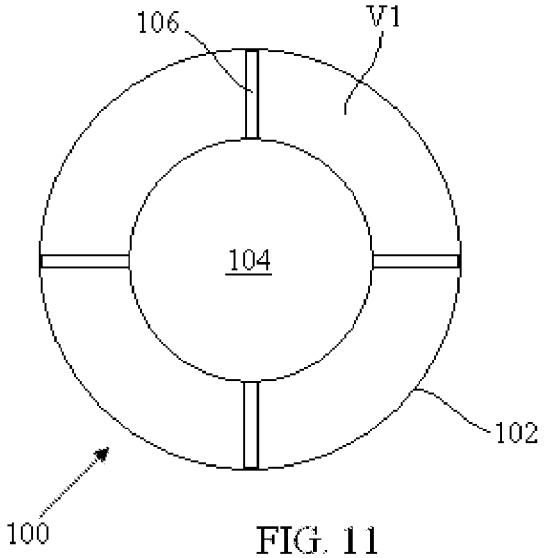
FIG. 11
FIG. 12
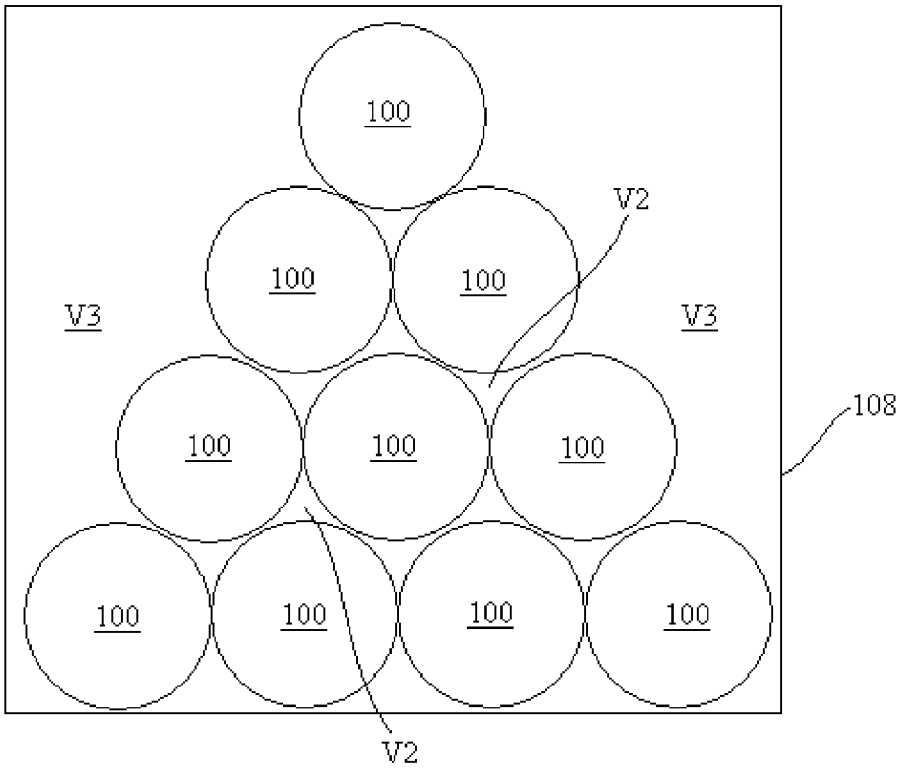

MISSILE CANISTER

This invention relates to a missile canister.

Missile canisters are used to accommodate missiles during transit to provide protection. Missiles can also be deployed in missile canisters ready for launch and may be stacked together in a multi-canister missile system.

The current state of the art for launching missiles is generally divided into two categories, namely hard launch and cold launch.

In a hard launch system, the missile motor is ignited while the missile is in a missile launch canister. This approach requires significant efflux management due to the forces and debris produced as a consequence of allowing the primary missile launch motor to be ignited within the launch tube. In such a launch system the missile accelerates rapidly and conducts turnover with a high vertical velocity component.

In a cold launch system, the missile rocket motor is ignited only after it has been "pushed" out of its canister and in some instances orientated towards its intended flight path. Cold launch systems include apparatus in the launch tube to eject a missile from the tube.

Hard and cold launch systems require missile canisters for accommodating missiles during transit and prior to launch. In multi-canister systems, a plurality of canisters are stacked together one adjacent to another. Such multi-canister systems can be employed to launch multiple missiles in a relatively short period.

Typically, a missile canister 100 is formed of a cylindrical vessel 102 having a circular cross-section which accommodates a missile 104 along its longitudinal axis, as shown in FIG. 11. A circular cross-section is well suited for withstanding the forces caused by the high gas pressures generated during launch of a missile. In this regard, the high pressure generally gives rise to hoop stress in the circular vessel and the load is generally distributed evenly about the circumference without causing significant stress points. Missile canisters can therefore be fabricated from metallic material which are relatively easy to manufacture and have a high tensile strength to resist the circumferencial stress field.

However, since a missile canister must accommodate not only the body of a missile but also the wings or fins 106 of the missile, a circular canister must have a radius which is sufficiently large to accommodate the most radially outward portion of the missile, which typically means the wings or fins. Consequently, there is a relatively large internal volume V1 which is unoccupied when a missile is accommodated within the canister causing inefficient use of space.

Further, as shown in FIG. 12, circular missile canisters are inherently unsuited for stacking for transport and deployment, and are relatively unstable. When stacked together, there is a relatively large volume V2 left unused between the canisters meaning that the stacked canisters have an unnecessarily high foot-print. It will also be appreciated that transport containers 108 are typically rectilinear and therefore the volume V3 may also cause inefficient use of space.

The present invention provides an improved missile canister.

Therefore, the present invention provides a missile canister for accommodating a missile along a longitudinal axis of the canister, the canister comprising a plurality of generally planar longitudinal wall portions connected together to form a tubular vessel having a polygonal cross-section, the interconnecting portions between wall sections are generally flexible so that when a missile is launched the bending moment at the interconnecting portions generated by the increase of pressure in the vessel is substantially less than the bending moment generated at the wall portions.

In this way, the corners behave similarly to a pivot point about which bending moment is reduced so that stress on the canister is resisted by walls rather than the corners.

In order that the present invention may be well understood, embodiments thereof, which are given by way of example only, will now be described with reference to the accompanying drawings, in which:

FIG. 3 shows a plurality of such missile canisters stacked together;

FIG. 5 shows a simplified bending moment diagram for one canister wall shown in FIG. 4;

FIG. 11 shows a missile accommodated in a circular missile canister; and

FIG. 12 shows a plurality of circular missile canisters stacked together.

Figure 1:
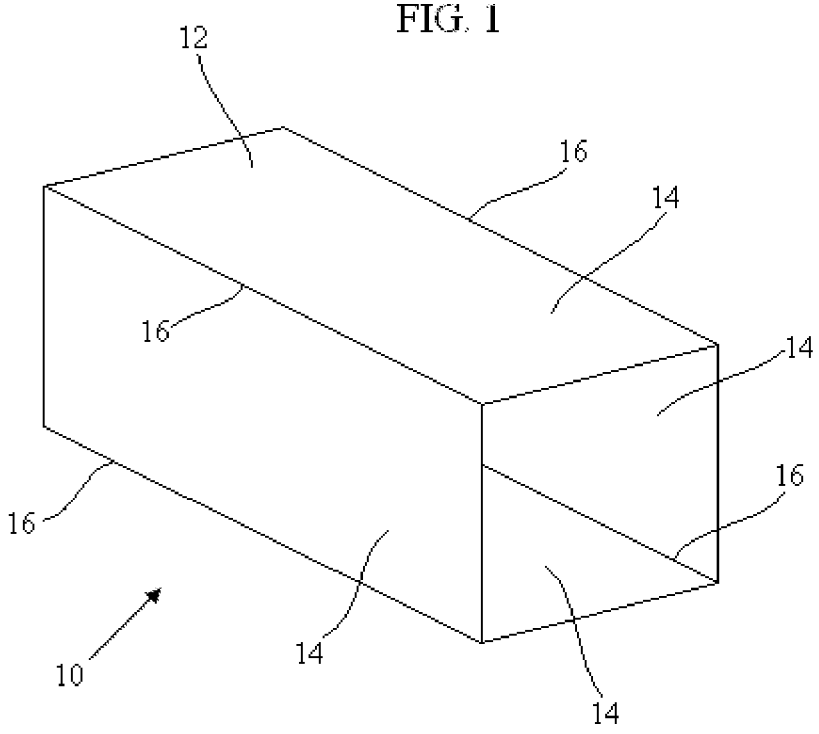
FIG. 1 shows a rectangular missile canister.

Referring to FIG. 1, a missile canister 10 is shown for accommodating a missile along a longitudinal axis of the canister. The canister comprises a plurality of generally planar rectilinear longitudinal wall portions 14 connected together to form a tubular vessel 12 having a polygonal cross-section. As shown in this example a generally square cross-section is formed although depending on the configuration of the missile, other cross-sectional shapes may be preferred, such as triangular, rectangular or pentagonal. Interconnections 16 are provided between wall sections. As described in greater detail below the interconnections 16 are generally flexible so that when a missile is launched the bending moment at the interconnections generated by the increase of pressure in the vessel is substantially less than the bending moment generated at the wall portions 14.

Figure 2:
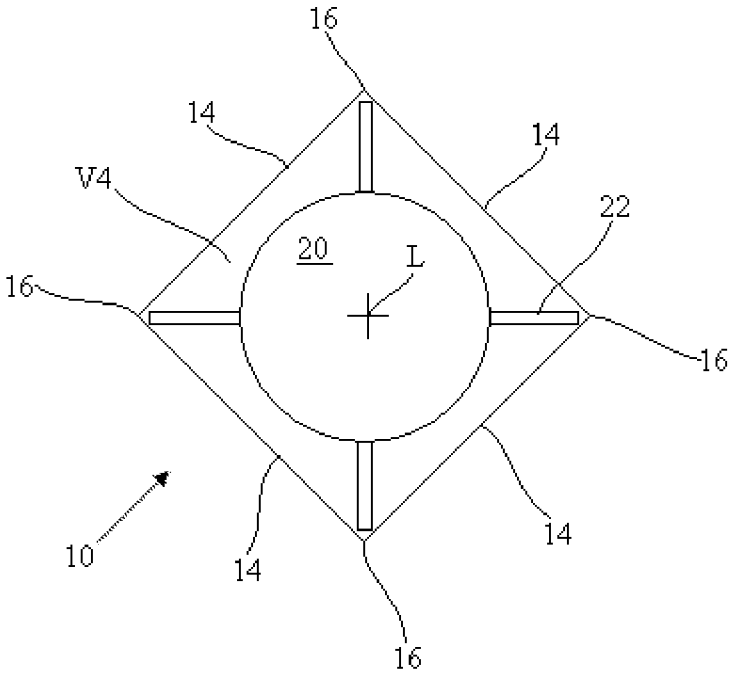
FIG. 2 shows a cross-section of the missile canister accommodating a missile.

FIG. 2 shows a missile 20 accommodated in the missile canister 10. As the canister has a square cross-section, the four fins 22 of the missile are received in the corners formed by the interconnections 16 between the wall portions 14. In this regard, the lateral distance of the vessel from the central longitudinal axis L of the canister is greatest at the corner which is coincident with the most radially outermost portions of the missile. The wall portions 14 of the vessel are closer to the axis L and therefore the unoccupied or void volume V4 of the canister is less than the void V1 shown in FIG. 11. Accordingly, the canister utilises space more efficiently. Other missile configurations, for example, with say three or five fins, would require a canister having a triangular or pentagonal cross-section.

Additionally, as shown in FIG. 3, the canisters 10 can be more efficiently stacked together for transport and deployment thereby efficiently utilising space inside a transport container 24 or when deployed on for example a vehicle or ship. In this regard, the volume V5 between the canisters is close to zero and the volume V6 between the stack and a container may also be relatively small.

Figure 4:
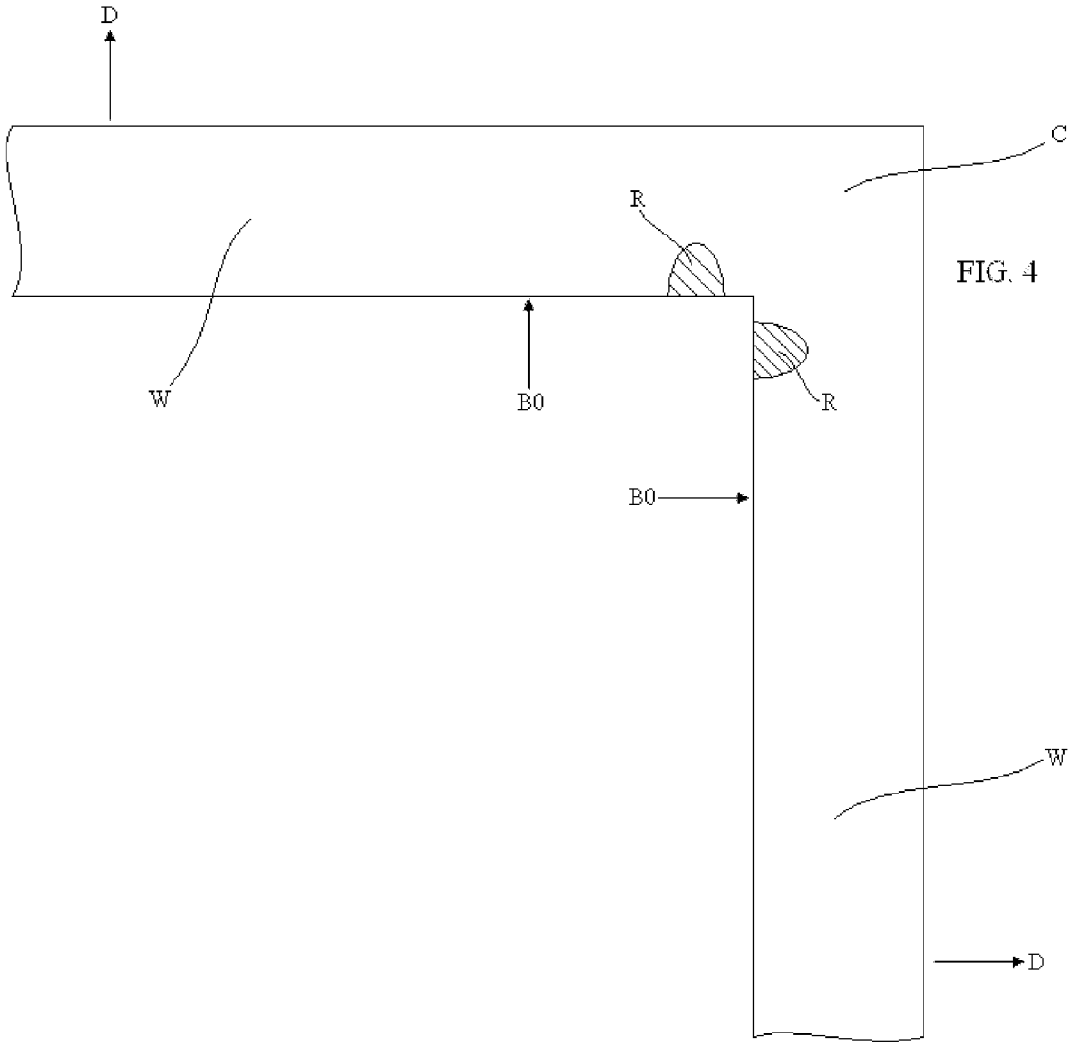
FIG. 4 shows a typical loading distribution along one wall of a square missile canister.

A cross-sectional view of part of a typical square canister is shown in FIG. 4. A corner C is shown interconnecting two adjacent wall portions W. During use of a missile accommodated in the canister, high gas pressures are generated within the canister which cause significant deflection of the wall portions in a outward direction D. The corners C are stiff and therefore the deflections cause a high bending moment and consequent stress at the corners. The highest bending stresses are generated in regions R in the interconnecting portions proximate the corners.

FIG. 5 approximates the bending moments in a canister wall portion W extending between two stiff corners C. The force applied by the gas pressure is shown by a uniformly distributed load L. It will be appreciated that the exact loading on the canister is somewhat more complicated than represented in FIG. 5 but the Figure is sufficient for explaining the behaviour of the canister in use.

The bending moment Bw at the centre of the wall portion W is less than the bending moment −Bc at the corners. The bending moment at the centre of the wall portion is positive whereas the bending moment at the corners is negative, the inflection occurring where bending moment is zero at B0. This bending moment distribution is caused because the corners are stiff and resist relative angular movement of the adjacent wall portions at the corners. The high bending stress at the corners of the canister can be resisted by strengthening the corners, either by increasing the thickness of the canister or by providing reinforcing struts extending between adjacent wall portions at the corner. Both these solutions complicate the construction of the canister and increase cost. Further, reinforcing struts occupy space which could otherwise be occupied by the fins of missile and therefore require an increase in the size of the canister.

Embodiments of the present invention overcome the significant stresses which occur at the corners of the missile canister not by increasing the strength of the corners portions, but rather the interconnections between the wall portions are weakened. The weakened corners are flexible and allow movement between adjacent wall portions at the corner. Therefore, the bending moment at the corners is reduced such that it is substantially less than the bending moment in the wall portion.

Figure 6A:
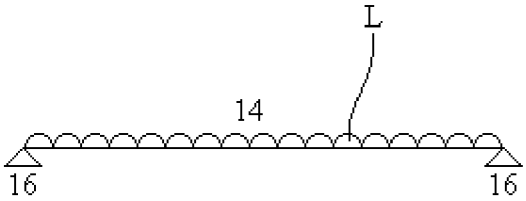
FIG. 6A shows a typical loading distribution for a canister wall embodying the invention.
Figure 6B:
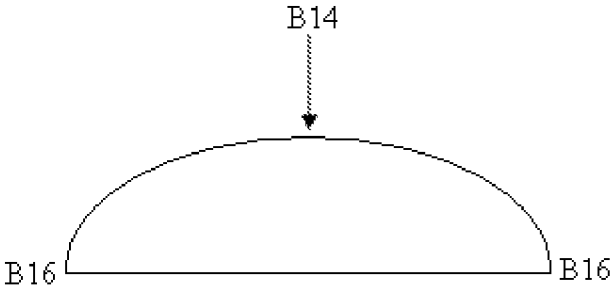
FIGS. 6B and 6C show bending moment diagrams for a canister wall embodying the invention.

An approximation of the bending moments generated in embodiments of the invention is shown in FIG. 6. FIG. 6A is a wall portion 14 extending between interconnections 16. The forces provided by the high gas pressure generated in use of the canister are shown by uniformly distributed load L. The interconnections 16 are represented by simple supports which by definition are perfect pivot points about which bending moment is zero. In this configuration, the distribution of bending moments is shown in FIG. 6B, in which bending moment B16 at the interconnections is zero and the bending moment B14 at the centre of the wall portion 15 is relatively large. Therefore bending stress at the corners is significantly reduced compared to a typical square canister.

The theoretical bending moment diagram shown in FIG. 6B may not be achievable in practice because of the additional requirements of a missile canister. For example, an interconnection 16 may be formed by a hinge functioning as a simple support. However, there is also a requirement that the canister contains high pressure gas without allowing gas to escape. The configuration of a hinge may not be suited therefore for use in a missile canister.

Figure 7:
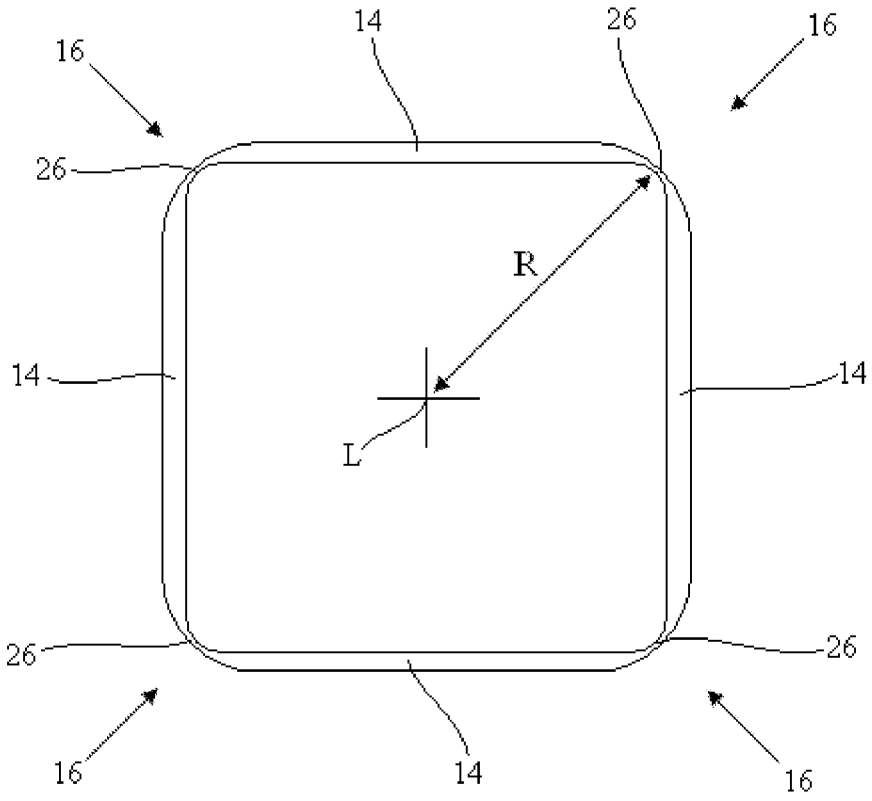
FIG. 7 shows a cross-section through the canister.
Figure 8:
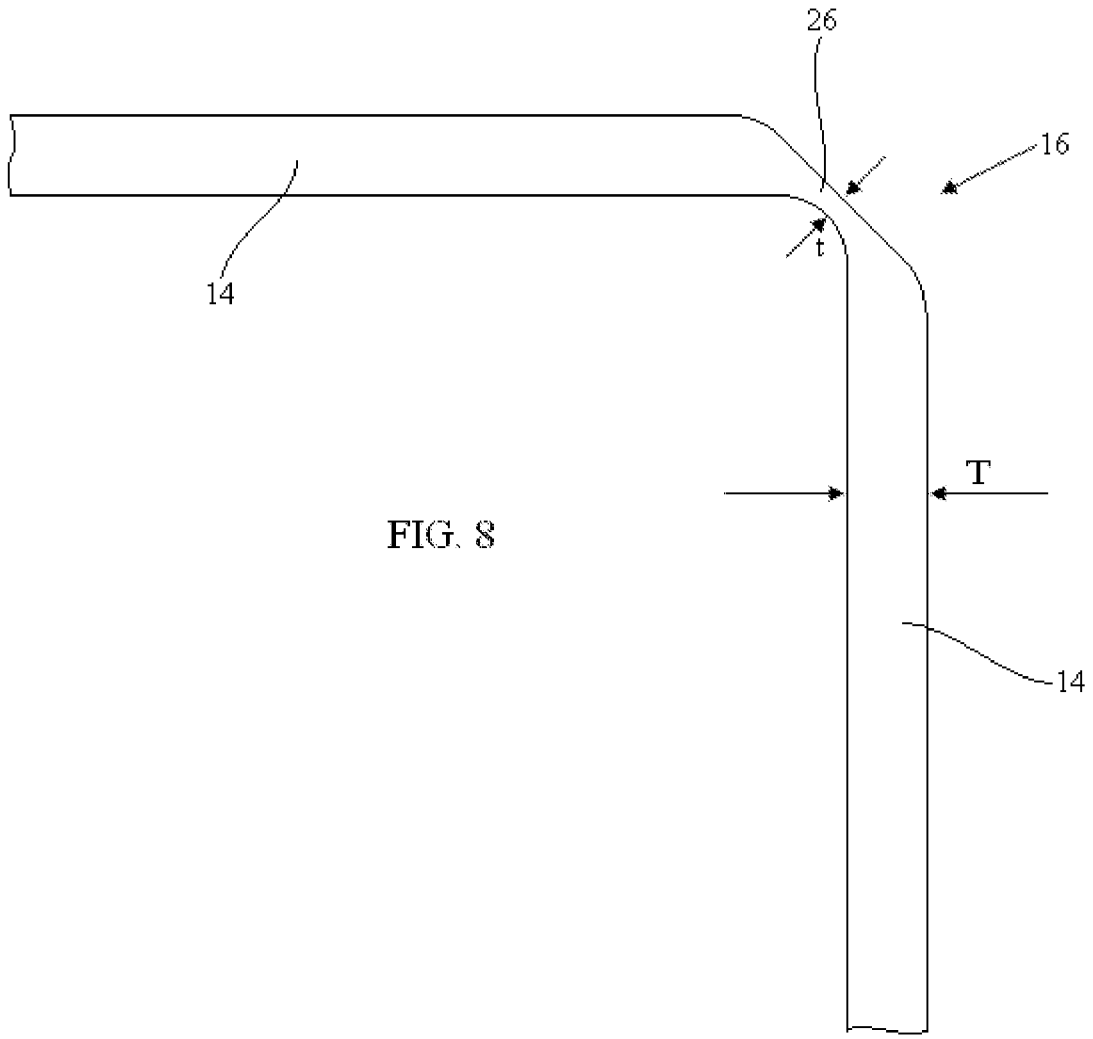
FIG. 8 shows part of the canister in more detail.

In one preferred embodiment of the present invention as shown in FIGS. 7 and 8, thin wall portions 26 form the interconnections 16 between wall portions 14. The thin wall portions 26 are configured to decrease bending moment at the interconnection 16 so that it is substantially less than the bending moment at the wall portions. The bending moment at the interconnections is not zero because the thin wall portion has some stiffness. However, the thickness of the thin wall portions is selected so that relatively little radial, or lateral, compressive force is generated in the thin wall portion which would otherwise resist relative movement between adjacent wall portions 14. In this regard, the ratio of the thickness t of the thin wall portion to the radial or lateral distance R between the longitudinal axis and the corner is preferably equal to or less than 1:10 and more preferably less than 1:20.

The corner thickness 't' and wall thickness 'T' depend on the specific size and demands imposed by the system requirements, i.e. available space & missile calibre. An exemplary aspect ratio of t:T is 5/18 (i.e. 0.28) but this could vary according to the working pressure for example between 0.28+/−0.5.

Figure 6C:
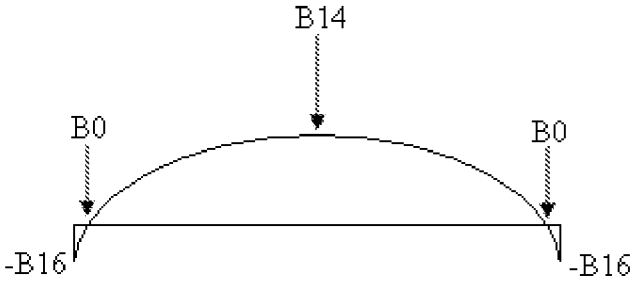

In this way, the bending moment diagram for a wall portion 14 of the missile canister shown in FIGS. 7 and 8 is as shown in FIG. 6C. In this latter Figure, the bending moment −B16 at the interconnections 16 is substantially less than the bending moment B14 at the centre of the wall portions 14. However, as the thin wall portions 26 have some internal stiffness, an inflection occurs at B0 where the bending moment in the wall portion is zero. However, compared to FIG. 5, the inflection points occur relatively close to the corner, and the bending moment B16 is substantially less than the bending moment B14.

Figure 9:
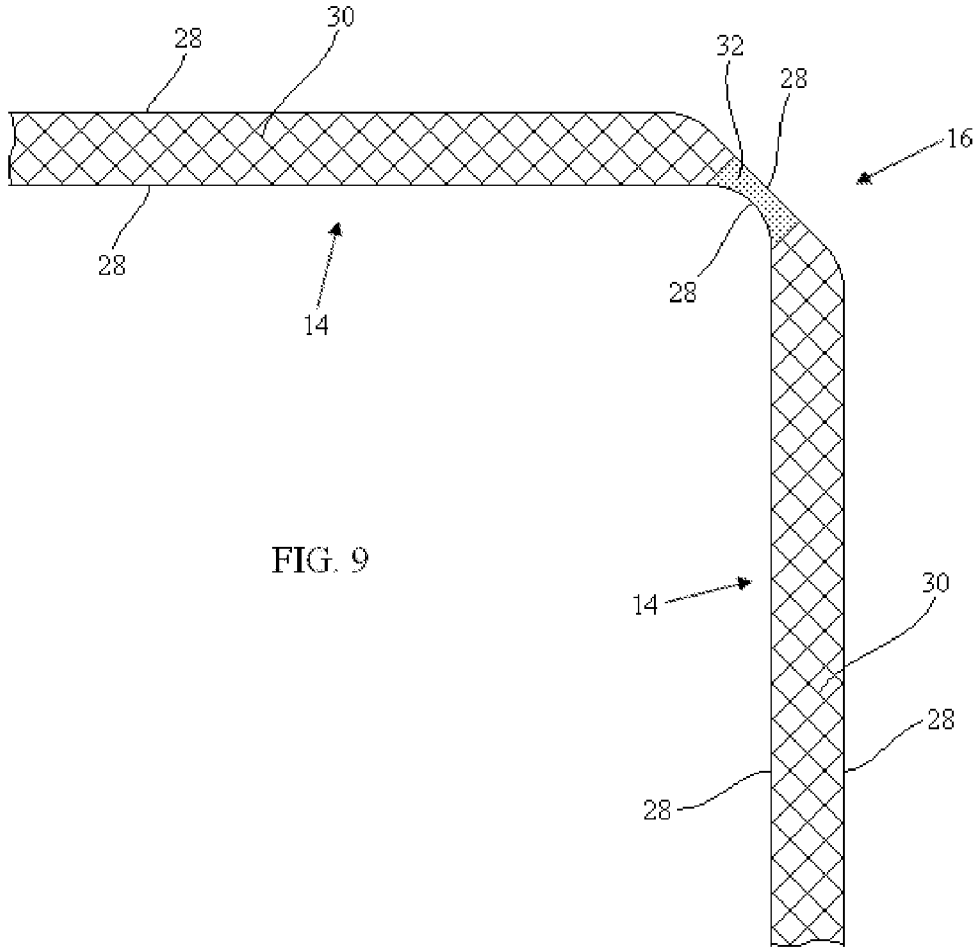
FIG. 9 shows a material construction of the canister.

The wall portions are configured to resist compressive and tensile loads and shear stresses through the wall. In one arrangement shown in FIG. 9, the vessel is constructed from a composite material which behaves similarly to an I-beam. The wall portions 14 comprise a skin 28 covering a core 30. The tensile and compressive loads are carried by the skin, similarly the flange of an I-beam, whilst shear stresses are carried by the core, like the web of an I-beam. The skin may be formed from carbon fibre reinforced plastics whilst the core may comprise a tessellated configuration, such as a honeycomb, which has high compressive strength. The interconnecting portions 16 may comprise a high tensile skin 28 covering a low compression flexible core 32, which may be a low density foam material. The skin 28 may extend around the entire periphery of the wall portions 14 and interconnecting portions 16 of the canister. Additional reinforcing elements or inserts may be provided for attaching items such as a breech, arrestors, or missile connections. The reinforcing elements provide additional strength by spreading the applied load over the composite material.

Figure 10A:
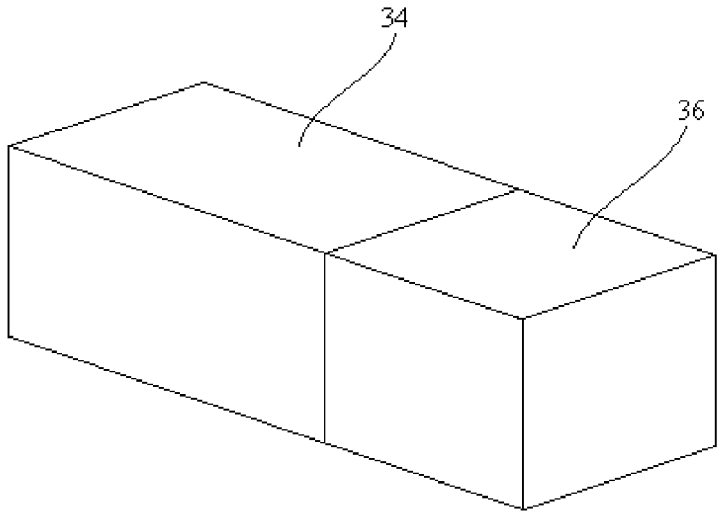
FIGS. 10A and 10B show a further missile canister.
Figure 10B:
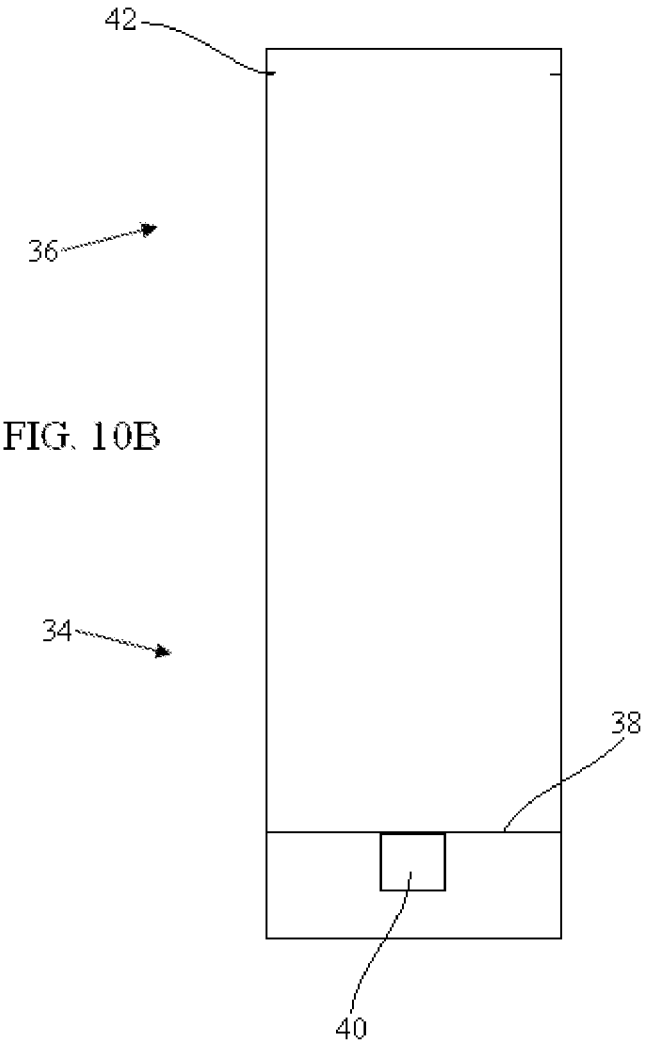

The materials of the wall portions may not be homogenous throughout the longitudinal extent of the canister. As shown in FIG. 10A, the breech end portion 34 may be formed from different materials having different properties than the materials forming the muzzle end portion 36. In use, the breech end portion 34 accommodates the means for propelling a missile from the canister whereas the muzzle end portion 36 accommodates the forward part of the missile. In a hard launch system, the breech end portion 34 accommodates a rocket motor which is ignited to eject a missile from the canister. As shown in FIG. 10B, in a cold launch system, the breech end portion 34 accommodates a piston 38 and an energetic material 40 which is ignited to propel the piston along the tube. This movement of the piston ejects a missile from the canister. Piston arresters 42 are provided for retaining the piston in the canister after launch.

It will be appreciated that in either hard or cold systems, on launch greater gas pressure is generated in the breech end portion 34 of the canister than the muzzle end portion 36.

Accordingly, the material properties of the breech end portion 34 are designed to withstand greater stresses that those of the muzzle end portion. If the canister is made from a composite material, the core of the breech end portion has greater compressive strength than that of the core of the muzzle end portion. For example the core of the breech end portion may be formed of a high density foam, whereas the core of the muzzle end portion may be formed of a low density foam.

The invention also includes any novel features or combinations of features herein disclosed whether or not specifically claimed. The abstract of the disclosure is repeated here as part of the specification.

The invention claimed is:

1. A missile canister for accommodating a missile along a longitudinal axis of the canister, the canister comprising a plurality of generally planar longitudinal wall portions connected together by interconnecting portions to form a tubular vessel having a polygonal cross-section, wherein the interconnecting portions between wall sections comprise a thin wall section relative to the thickness of the wall portions and are generally flexible to allow movement between adjacent wall portions, the relative thickness and the flexibility of the interconnecting portions is configured such that when a missile is launched the bending moment at the interconnecting portions generated by the increase of pressure in the vessel is substantially less than the bending moment generated at the wall portions.

2. A missile canister as claimed in claim 1, wherein the interconnecting portions allow relative angular deflection between adjacent wall portions at respective interconnecting portions when a missile is launched.

3. A missile canister as claimed in claim 1, wherein the interconnecting portions support the wall portions therebetween.

4. A missile canister as claimed in claim 1, wherein the thickness "t" of the thin wall sections relative to the thickness "T" of the wall portions is 0.28+/−0.5.

5. A missile canister as claimed in claim 1, wherein the interconnecting portions and the wall portions comprise a skin and a core, the core of the wall portions and the interconnecting portions having different compressive strengths, the core of the wall portions having higher compressive strength relative to the compressive strength of the core of the interconnecting portions.

6. A missile canister as claimed in claim 1, wherein the missile canister is made from a composite material having a skin which has a high tensile strength in the hoop direction and a core which in the wall portions has a higher compressive strength in a radial direction relative to the compressive strength in a radial direction of the interconnecting portions.

7. A missile canister as claimed in claim 1, wherein the canister comprises a breech end portion and a muzzle end portion, and the wall portions are configured to have greater compressive strength in the breech end portion than in the muzzle end portion.

8. A missile canister according to claim 7, wherein the canister is made from a composite material, the core of the breech end portion being formed of a high density foam, whereas the core of the muzzle end portion is formed of a low density foam.

9. A missile canister according to claim 5, wherein the core of the wall portions has a tessellated configuration.

* * * * *